US006782825B2

(12) United States Patent
Sejima et al.

(10) Patent No.: US 6,782,825 B2
(45) Date of Patent: Aug. 31, 2004

(54) PRINTING UNIT OF A SHEET-FED PRINTING PRESS

(75) Inventors: Atsushi Sejima, Fuchu (JP); Masahiro Hino, Fuchu (JP)

(73) Assignee: Ryobi Ltd. (JP)

( * ) Notice: Subject to any disclaimer, the term of this patent is extended or adjusted under 35 U.S.C. 154(b) by 0 days.

(21) Appl. No.: 10/418,010

(22) Filed: Apr. 16, 2003

(65) Prior Publication Data

US 2003/0196564 A1 Oct. 23, 2003

(30) Foreign Application Priority Data

Apr. 17, 2002 (JP) ..... 2002-115028
Oct. 31, 2002 (JP) ..... 2002-317441

(51) Int. Cl.[7] ..... B41F 27/12
(52) U.S. Cl. ..... 101/477; 101/451.1; 101/418
(58) Field of Search ..... 101/212–219, 101/477, 415.1, 418, 479, 378, 382.1

(56) References Cited

U.S. PATENT DOCUMENTS 5,622,111 A * 4/1997 Bachmeir et al. ..... 101/415.1
6,026,747 A * 2/2000 Carme et al. ..... 101/415.1
6,325,322 B1 * 12/2001 Lewis ..... 242/538.2
6,539,859 B2 * 4/2003 Williams ..... 101/175

* cited by examiner

*Primary Examiner*—Minh Chau
(74) *Attorney, Agent, or Firm*—Perkins Coie LLP

(57) ABSTRACT

A printing unit of a sheet-fed printing press for printing on sheets includes a plate cylinder having a circumference, on which a recess is formed; a feed reel mounted within the recess for feeding a printing film onto the circumference of the plate cylinder so as to introduce an image forming region for each printing operation; an image forming device for forming an image on the image forming region of the printing film fed on the circumference of the plate cylinder with the first edge of the image forming region positioned at an edge of the recess closer to the rewind reel; a rewind reel mounted within the recess for rewinding the printing film from the circumference of the plate cylinder; and a control unit for controlling the length of the printing film to be fed from the feed reel onto the circumference of the plate cylinder, based upon the length of sheets to be printed for each printing operation.

11 Claims, 6 Drawing Sheets

PRINTING UNIT OF A SHEET-FED PRINTING PRESS

CROSS REFERENCE TO RELATED APPLICATION

This application claims priority from Japanese Patent Application Nos. 2002-115028 and 2002-317441, which are incorporated herein by reference.

BACKGROUND OF THE INVENTION

1. Field of the Invention

The present invention relates to a printing unit of a sheet-fed printing press.

2. Related Art

As illustrated in FIG. 6, a conventional printing unit of the printing press includes plate cylinder 2, which carries printing film 1 therearound and rotates, ink feeding part 3 for feeding ink on the printing film 1 on the plate cylinder 2, rubber cylinder (not shown) onto which ink is transferred from the printing film 1, and an impression cylinder (not shown) for pressing and holding a sheet with the rubber cylinder so as to enable the ink to be transferred from the rubber cylinder to the sheet.

The printing press of FIG. 6 is a digital printing press, in which the printing film 1 having such a length as to enable several images to be formed thereon is rolled up and set to the plate cylinder 2 for easy replacement of the printing film 1. Specifically, the plate cylinder 2 forms on its circumference recess 4, in which a roll of the printing film 1 is mounted, and includes feed reel 5 for feeding the printing film 1 onto the circumference of the plate cylinder 2, and rewind reel 6 for rewinding the printing film 1 by holding the leading edge 1*a* thereof so as to draw the film from the circumference of the plate cylinder 2.

Once the printing film 1 is set on the plate cylinder 2, image forming device 7, which is secured in place with a predetermined clearance to the circumference of the plate cylinder 2, forms an image on the printing film 1 placed on the circumference of the plate cylinder 2 so as to use the printing film 1 as a press plate. The ink feeding part 3 feeds ink on the printing film 1 so that the image is printed on the sheet via the rubber cylinder. Subsequent to completing series of printing operations, the rewind reel 6 rewinds the printing film 1 so as to draw the same from the circumference of the plate cylinder 2, while the feed reel 5 successively feeds the printing film 1 onto the circumference of the plate cylinder 2. That is, in the printing press having the printing unit as illustrated in FIG. 6, another printing image can be formed on the printing film 1 fed from the feed reel 5 by the image forming device 7, thereby omitting the necessity to replace the plate every time the printing operation is performed, and hence achieving repeated printing operations by a single roll of the printing film 1.

According to the printing unit as described above, various sizes of sheets can be printed. In each operation, the image forming device 7 forms an image on an image forming region of the printing film 1. The image forming region corresponds in size to each of the sheets and has a first edge and a second edge respectively corresponding to a leading edge and a trailing edge of each of the sheets. The image is formed on the image forming region with the first edge thereof positioned at an edge of the recess closer to the rewind reel. In the conventional printing unit, the printing film 1 is rewound to present a new region onto the circumference of the plate cylinder 2, thereby replacing the entire region of the printing film 1 extending between the feed reel 5 and the rewind reel 6 for another printing image, even if each sheet has a length shorter than this circumferential length. That is, regardless of the length of sheets to be printed, the printing film 1 is fed from the feed reel 5 so as to have the entire region on the circumference replaced by a newly fed region, which has substantially the same length as the entire circumferential length of the plate cylinder 2 between the feed reel 5 and the rewind reel 6.

In consideration of the above, it is an object of the present invention to provide a printing unit of the sheet-fed printing press that is capable of reducing the amount of the printing film to be consumed than a conventional printing unit does.

SUMMARY OF THE INVENTION

According to one aspect of the present invention, there is provided a printing unit of a sheet-fed printing press for printing on sheets that includes a plate cylinder, a feed reel, an image forming device, a rewind reel and a control unit. The plate cylinder has a circumference, on which a recess is formed. The feed reel is mounted within the recess for feeding a printing film onto the circumference of the plate cylinder so as to introduce an image forming region for each printing operation. The image forming region corresponds in size to each of the sheets and having a first edge and a second edge respectively corresponding to a leading edge and a trailing edge of each of the sheets. The image forming device is designed to form an image on the image forming region of the printing film fed on the circumference of the plate cylinder with the first edge of the image forming region positioned at an edge of the recess closer to the rewind reel. The rewind reel is mounted within the recess for rewinding the printing film from the circumference of the plate cylinder. The control unit is designed to control the length of the printing film to be fed from the feed reel onto the circumference of the plate cylinder, based upon the length of sheets to be printed for each printing operation.

In the printing unit having the above arrangement, the length of the printing film to be fed from the feed reel is controlled based upon the length of sheets to be printed. This feeding arrangement achieves the reduction of the printing film to be consumed as compared with the conventional printing unit, in which the printing film is fed from the feed reel by a constant length regardless of the length of sheets to be printed so as to replace a region on the circumference of the plate cylinder entirely by a new region. As used throughout the description, the length of sheets or a sheet is meant to be a length thereof along the circumferential direction of the plate cylinder.

Preferably, the control unit controls the length of the printing film to be fed from the feed reel so that a region of the printing film positioned at a boundary between the circumference of the plate cylinder and the recess in a previous printing operation is prevented from being positioned within a film forming region to be used in a current printing operation when the printing film has been fed from the feed reel.

Since the printing film is sharply bent at the boundary between the circumference of the plate cylinder and the recess, the printing film is likely to be creased at the boundary. This creased portion may cause uneven printing if an image is formed on that portion. Therefore, in the above arrangement, the length of the printing film to be fed from the feed reel is controlled so as not to have the creased portion positioned in an image forming region of the printing film for each printing operation. Thus, uneven printing can be prevented.

Preferably, the control unit controls the length of the printing film to be fed from the feed reel so that, when the total of the length of sheets to be printed in a current printing operation and the length of sheets which have been printed in a previous printing operation is longer than the circumferential length of the plate cylinder between the feed reel and the rewind reel, the printing film is fed from the feed reel by a length substantially equal to the circumferential length so as to replace a region of the printing film on the circumference of the plate cylinder entirely by a new region, and when the total of the length of sheets to be printed in a current printing operation and the length of sheets which have been printed in a previous printing operation is shorter than the circumferential length of the plate cylinder between the feed reel and the rewind reel, the printing film is fed from the feed reel by a length not less than the length of sheets which have been printed in a previous printing operation, but not more than the length obtained by subtracting the length of sheets to be printed in a current printing operation from the circumferential length.

Accordingly, when the total of the length of sheets to be printed in a current printing operation and the length of sheets which have been printed in a previous printing operation is longer than the circumferential length of the plate cylinder between the feed reel and the rewind reel, the printing film is fed from the feed reel by a length substantially equal to the circumferential length so as to replace a region of the printing film on the circumference of the plate cylinder entirely by a new region. By this control, an image is not printed on the creased portion of the printing film, thus preventing uneven printing.

On the other hand, when the total of the length of sheets to be printed in a current printing operation and the length of sheets which have been printed in a previous printing operation is shorter than the circumferential length of the plate cylinder between the feed reel and the rewind reel, a region of the printing film on the circumference of the plate cylinder is not replaced entirely by a new region. As a result, the amount of the printing film 1 to be consumed can be reduced.

Preferably, when plural printing operations are continuously performed, the length of sheets to be printed in each printing operation is inputted into the printing unit so that the control unit sorts the order of the plural printing operations based upon the inputted lengths of sheets so as to minimize the length of the printing film to be fed from the feed reel.

With the above arrangement, the control device 20 properly sorts the order of the printing operations so as to minimize the length of the printing film 1 based upon the inputted information on the length of sheets. This can further reduce the amount of the printing film 1 to be consumed.

According to a second aspect of the present invention, there is provided a printing unit of a sheet-fed printing press for printing on sheets that includes a plate cylinder, a feed reel, an image forming device, a rewind reel and a control unit. The plate cylinder has a circumference, on which a recess is formed. The feed reel is mounted within the recess for feeding a printing film onto the circumference of the plate cylinder so as to introduce an image forming region for each printing operation. The image forming region corresponds in size to each of the sheets and has a first edge and a second edge respectively corresponding to a leading edge and a trailing edge of each of the sheets. The image forming device is designed to form an image on the image forming region of the printing film fed on the circumference of the plate cylinder with the first edge of the image forming region positioned at an edge of the recess closer to the rewind reel. The rewind reel is mounted within the recess for rewinding the printing film from the circumference of the plate cylinder. The control unit is designed to control the length of the printing film to be fed from the feed reel onto the circumference of the plate cylinder, based upon the length of an image printed on the printing film on the circumference of the plate cylinder.

By controlling the length of the printing film to be fed from the feed reel based upon the size of an image, the amount of the printing film to be consumed can be reduced in the same manner as the operation under the control based upon the length of sheets.

Preferably, the control device is capable of performing sheet-length-based feeding control for feeding the printing film from the feed reel by the length substantially equal to the circumferential length of the plate cylinder between the feed reel and the rewind reel so as to replace a region of the printing film on the circumference of the plate cylinder between the feed reel and the rewind reel entirely by a new region, image-size-based feeding control for controlling the length of the printing film to be fed from the feed reel onto the circumference of the plate cylinder based upon the size of an image to be formed on the printing film on the circumference of the plate cylinder, and sheet-size-based feeding control for controlling the length of the printing film to be fed from the feed reel onto the circumference of the plate cylinder based upon the length of sheets to be printed. In this arrangement, the printing unit further includes a switching means for selectively switching the film feeding control between the sheet-length-based feeding control, the image-size-based feeding control and the sheet-size-based feeding control.

According to the above arrangement, the control mode for the length of the printing film to be fed from the feed reel is selected according to the length of sheets, the size of an image and the number of sheets to be printed in a single printing operation, or any other conditions. For example, when the size of an image is smaller than the length of sheets, the image-size-based feeding control is selected so as to effectively reduce the amount of the printing film to be consumed.

Preferably, the printing unit of a sheet-fed printing press further comprises a cleaning device for cleaning the printing film, which has been fed on the circumference of the plate cylinder, before an image is formed on the printing film.

On a portion of the printing film positioned at the boundary between the circumference of the plate cylinder and the recess, foreign matters caused during the printing operation are likely to be stuck. If this portion is positioned on the circumference of the plate cylinder after the printing film has been fed from the feed reel, the foreign matters stuck may cause an undesirable effect in an image forming process. Therefore, after the printing film 1 has been fed from the feed reel onto the circumference, it is cleaned by the cleaning device to remove such foreign matters to prevent any troubles.

Preferably, the printing unit of a sheet-fed printing press further includes a display means for displaying the fact that the number of printing operations which have been performed has exceeded the number of printing operations which can be performed by a single roll of the printing film set to the feed reel when the printing film is fed from the feed reel for each printing operation by the length substantially equal to the circumferential length of the plate cylinder between the feed reel and the rewind reel so as to replace a region on the circumference of the plate cylinder between the feed reel and the rewind reel entirely by a new region.

In the conventional printing unit of the printing press, a constant length of the printing film is fed from the feed reel so as to replace a region on the circumference of the plate cylinder between the feed reel and the rewind reel entirely by a new region, and therefore the number of the printing operations which can be performed by a single roll of the printing film set to the feed reel is constant. On the contrary, according to the printing unit of the present invention, the length of the printing film to be fed from the feed roll can be controlled based upon such as the length of sheets to be printed. As a result, the amount of the printing film to be consumed can be reduced as compared with the conventional printing unit, and therefore the number of printing operations which can be performed by a single roll of the printing film set to the feed roll can be increased. Also, the display means, which displays the fact that the number of printing operations which have been performed has exceeded the number of printing operations which can be performed by a single roll of the printing film set to the feed reel, enables the operator to confirm that the amount of the consumed printing film has been reduced as compared with the conventional printing unit.

BRIEF DESCRIPTION OF THE DRAWINGS

The above, and other objects, features and advantages of the present invention will become apparent from the detailed description thereof in conjunction with the accompanying drawings wherein.

FIG. 2A illustrates a state where an image for the first printing operation has been formed, and FIG. 2B illustrates a state where an image for the second printing operation has been formed.

FIG. 3A illustrates a state where an image for the first printing operation has been formed. Likewise, FIGS. 3B and 3C respectively illustrate states where images for the second and third printing operations have been formed.

DESCRIPTION OF THE PREFERRED EMBODIMENTS

Figure 1:
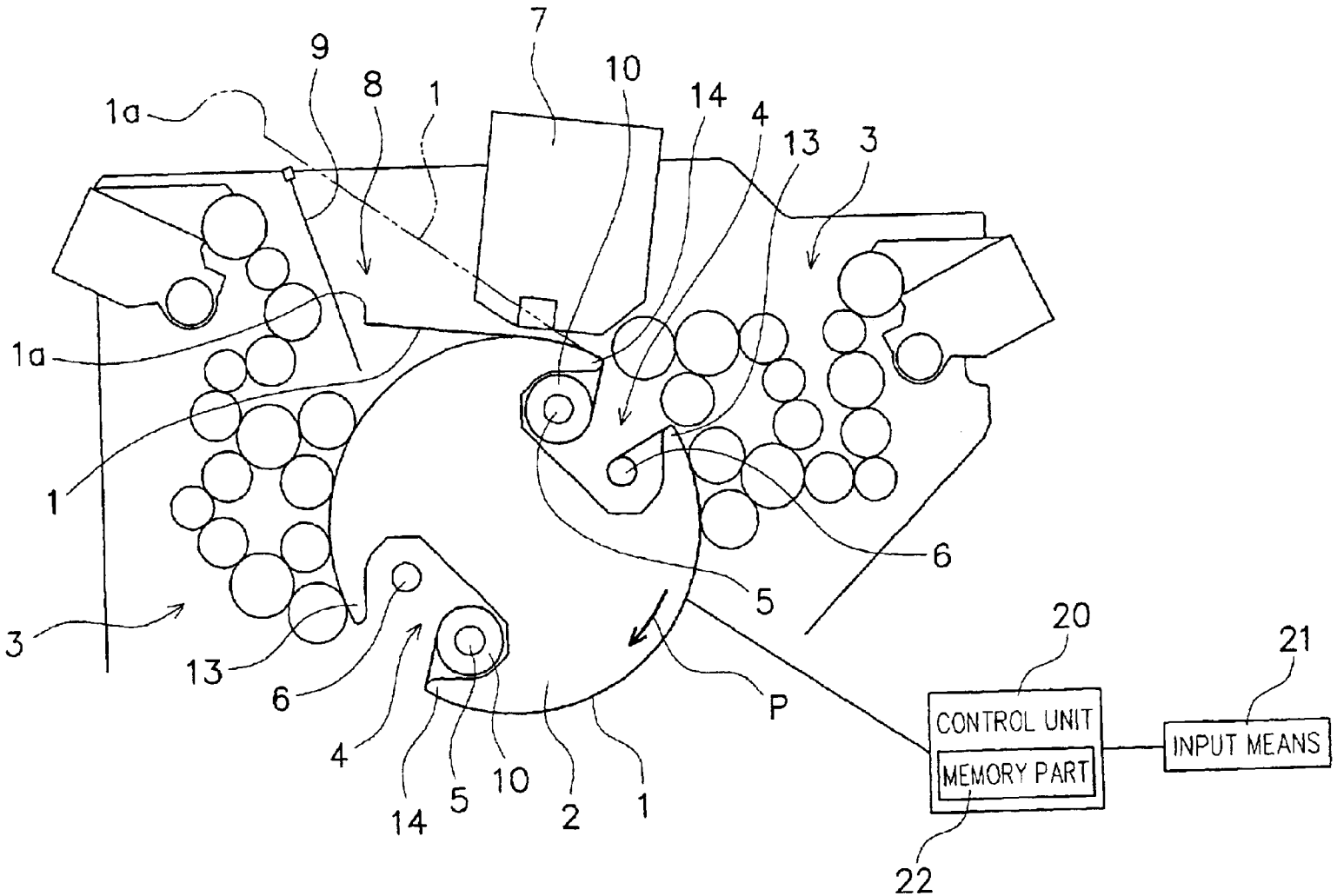
FIG. 1 is a schematic view of an essential part of the printing unit according to one embodiment of the present invention.
Figure 6:
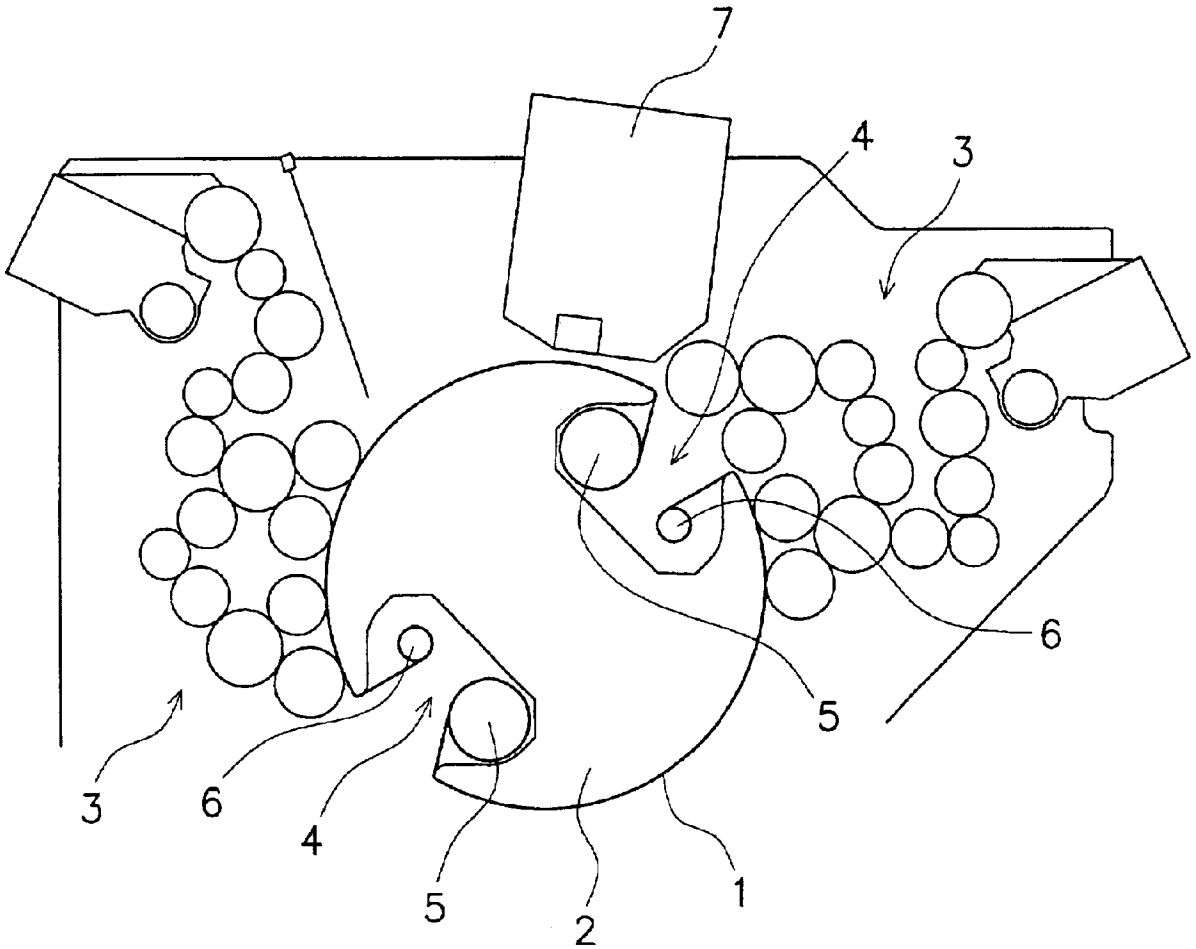
FIG. 6 is a schematic view of the essential part of the conventional printing unit.

An embodiment of the printing unit according to one embodiment of the present invention will be herein described with reference to the drawings attached hereto. FIG. 1 is a schematic view of the essential part of the printing unit according to this embodiment of the present invention, in which the same members or parts as those of the conventional printing unit of FIG. 6 are assigned the same reference numbers to omit the detailed description thereof.

The printing unit of this embodiment is for two-color printing, so that the plate cylinder 2 is structured to place two webs of the printing film 1 around the circumference. Specifically, two printing rolls 10 for feeding the respective webs of the printing film 1 are mounted at two places. For this, two sets of the feed reels 5 and the rewind reels 6 are arranged. Two sets of the ink feeding parts 3, each made up of several ink rollers, are also arranged so as to feed two colors of ink.

The plate cylinder 2 forms two recesses located on the circumference about 180 degrees opposite to one another. These recesses 4 extend in the axial direction of the plate cylinder 2, thereby each having an overall appearance of a recessed groove. By these recesses 4, the circumference of the plate cylinder 2 is divided into two sections, and the two webs of the printing film 1 are respectively placed around these sections.

The recesses 4 each are provided with the feed reel 5 for feeding a web of the printing film 1 onto a corresponding section for one color, and the rewind reel 6 for rewinding another web of the printing film 1 on another section for another color. The feed reel 5 and the rewind reel 6 respectively have axes extending along the axial direction of the plate cylinder 2. In the respective recesses 4, the rewind reels 6 are located on the downstream sides of the corresponding feed reels 5 with respect to the rotational direction of the plate cylinder 2, so that the webs of the printing film 1 are fed from the printing rolls 10 with their rear sides slidingly engaging edges 13, 14 of the recesses 4 of the circumference.

The image forming device 7 is secured in position above the plate cylinder 2 with a predetermined clearance between its bottom and the circumference of the plate cylinder 2. On the upstream side of the image forming device 7 is provided space 8 required for setting a new web of the printing film 1 on the plate cylinder 2. Light-shielding plate 9 is located on the upstream side of the space 8, extending towards the circumference of the plate cylinder 2.

Wet cleaning device (plate cleaning device) 50 and dry cleaning device (not shown) are located near the circumference of the plate cylinder 2 with a predetermined clearance thereto so as to clean the printing film 1, which pass through the clearance in contact with these cleaning devices.

The wet cleaning device 50 includes cleaning cloth 53 with a cleaning liquid impregnated therein, which contacts the printing film 1 on the circumference and cleans the same. Specifically, the wet cleaning device 50 includes cloth-feeding part 51 with an unused cleaning cloth 53 rolled up thereon, and cloth-collecting part 52 for winding up the cleaning cloth 53 in a roll, which was used for cleaning the printing film 1. The cloth-feeding part 51 and the cloth-collecting part 52 respectively have rotating shafts extending parallel to the axis of the plate cylinder 2. Inflatable member 54 having a bag-like shape is located near the circumference of the plate cylinder 2 so as to form a passage with the circumference of the plate cylinder 2, through which the cleaning cloth 53 fed from the cloth-feeding part 51 passes and is wound up on the cloth-collecting part 52. The inflatable member 54, which has been inflated with air fed thereinto brings the cleaning cloth 53 into contact with the printing film 1 on the circumference of the plate cylinder 2. The width of the cleaning cloth 53 (the length of the cleaning cloth 53 in a direction orthogonal to the winding direction) is substantially equal to the axial length of the plate cylinder 2. Accordingly, the printing film 1, which slidingly moves along the cleaning cloth 53 by the rotation of the plate cylinder 2 can be cleaned.

The dry cleaning device includes an elastic rotating roller made of such as rubber for scraping any foreign matters stuck on the printing film 1, and a suction part for sucking the foreign matters scraped by the rotating roller. The rotating roller is shiftable between a non-contact position at which the roller is held with a predetermined clearance to the printing film 1 on the circumference of the plate cylinder 2, and a contacting position at which the roller contacts the printing film 1 on the circumference of the plate cylinder 2 and scraps foreign matters from the printing film 1. Accordingly, when the rotating roller is to scrape foreign matters from the printing film 1 on the circumference of the plate cylinder 2, it is shifted to the contact position and rotated to scrape foreign matters from the printing film 1, while the suction part sucks the scraped foreign matters.

When a new web of the printing film 1 is to be set in the printing unit as illustrated in FIG. 1, the new printing roll 10 is set to the feed reel 5, and starting edge 1*a* of the printing roll 10 is pulled out from a corresponding recess 4, and the plate cylinder 2 is rotated in the P direction in FIG. 1 with pulling the starting edge 1*a*, thereby applying a tension force on the printing film 1. Thus, the printing film 1 is gradually fed on the circumference of the plate cylinder 2 so as to introduce an image forming region, which corresponds in size to each of sheets to be printed and has a first edge and a second edge respectively corresponding to a leading edge and a trailing edge of each of sheets. After winding up a predetermined length of the printing film 1 (i.e., the image forming region) on the circumference of the plate cylinder 2, the starting edge 1*a* of the printing film 1 is held by the rewind reel 6. Through these steps, the printing roll 10 and the printing film 1 are set to the plate cylinder 2. When the setting of the printing plate 1 on the circumference of the plate cylinder 2 has been completed, the printing operation is initiated.

Now, the description will be made for the printing operation. As described above, once the printing film 1 is set on the circumference of the plate cylinder 2, the image forming device 7, which is secured in position with a predetermined clearance to the circumference, forms an image on the image forming region of the printing film 1 placed on the circumference of the plate cylinder 2. Specifically, the printing film 1 is coated with a silicon layer, which is burned by laser radiated from the image forming device 7 so as to form an image on the printing film 1. The image forming device 7 thus forms the image on the printing film 1 with the first edge of the image forming region positioned at the edge 13 of the recess 4 closer to the rewind reel 6. In other words, a portion of the image formed on the printing film 1, which is positioned at the edge 13 closer to the rewind reel 6, is printed on the leading edge of the sheet. Then, silicon debris or any foreign matters stuck on the printing film 1 are removed by the wet cleaning device (plate cleaning device) 50 and the dry cleaning device (not shown). The printing film 1 with the image thereon is then presented to be used as a printing plate, onto which ink is fed from the ink feeding part 3. Thus, the image formed on the printing film 1 is printed on sheets.

After starting the second printing operation, the printing film 1 is wound up and drawn from the circumference of the plate cylinder 2 by the rewind reel 6, while it is fed from the feed reel 5, thereby introducing a new region of the printing film 1 on the circumference of the plate cylinder 2. Likewise to the previous printing operation, a new image is formed on the printing film 1 by the image forming device 7, so that this new image is printed on sheets.

According to the thus arranged printing unit of this embodiment, it is possible to continuously perform plural printing operations without the necessity to replace the printing plate as long as the current printing roll 10 remains.

In the thus arranged printing unit, control device 20 is provided so as to control the length of the printing film 1 fed from the recess 4 onto the circumference of the plate cylinder 2. This control device 20 includes input means 21 for inputting the information of the sheets to be printed and memory part 22 for storing the inputted information of the sheets, and is designed to properly control the length of the printing film 1 to be fed. Specifically, the control device 20 is capable of performing sheet-length-based feeding control for controlling the length of the printing film 1 to be fed from the feed roll 5 based upon the length of sheet to be printed, and circumferential-length-based feeding control for the length of the printing film 1 to be fed from the feed roll 5 based upon the circumferential length L1 (FIGS. 2 and 3) of the plate cylinder 2 between the feed reel 5 and the rewind reel 6 so that the printing film 1 is fed from the feed reel 5 by a length substantially equal to the circumferential length L1 so as to replace a region of the printing film 1 on the circumference of the plate cylinder 2 entirely by a new region.

An operation panel of a touch panel type is provided with the input means 21 for displaying such as the printing status of the printing unit and enabling the information of the sheets or the like to be inputted through a touching operation.

Figure 2B:
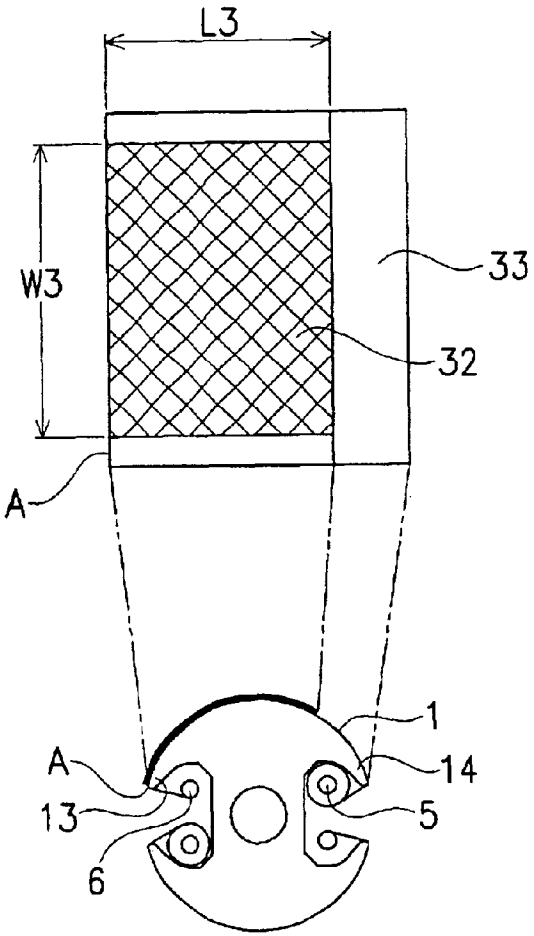
FIGS. 2A and 2B are schematic views illustrating the procedures for controlling the length of the printing film to be fed from the feed reel of the printing unit according to the one embodiment of the present invention. Specifically.

Now, the description will be made for the control of the feeding length of the printing film 1 with reference to FIGS. 2 to 4. Upper parts illustrated in FIGS. 2 and 3 each are the circumference of the plate cylinder 2 developed in plan. FIG. 4 is a flow chart of controlling steps of controlling the length of the printing film 1 to be fed.

In the first printing operation, the operator inputs the information of the sheets to be printed, such as the length L2 (the length corresponding to the circumferential length of the plate cylinder 2) and the width W2 (the length corresponding to the axial length of the plate cylinder 2). The inputted information is sent to the control device 20 and stored in the memory part 22. Then, an image is formed by the image forming device 7 within image forming region 30 (a cross-hatch part in FIG. 2A) of the printing film 1 on the circumference of the plate cylinder 2, in which the image forming region 30 of the printing film 1 corresponds in size to the sheets to be printed, that is, has a length and a width respectively equal to the length L2 and the width W2 (Step S300). At this moment, the downstream side of the image forming region 30, that is a region closer to the feed reel 5 on the circumference of the plate cylinder 2 is designated as unused region 31 which is not used in the printing operation. As described above, the printing operation is performed by using the image formed on the image forming region 30 (Step S301). Thus, the first printing operation is finished.

When the second printing operation is to be subsequently performed, that is for the operation when "NO" is chosen at the step S302, the operator inputs the length L3 and the width W3 of the sheets to be printed in the second printing operation. Upon inputting the information, the control device 20 controls the length of the printing film 1 according to the length L2 of the sheets printed in the first printing operation and the length L3 of the sheets to be printed in the second printing operation (Step S303).

The printing operation will be described by taking for example the first case where when the length L3 of the sheets to be printed in the second printing operation is longer than the length of the unused region 31 (L1–L2), that is, when the circumferential length L1 between a pair of the feed reel 5 and the rewind reel 6<the length L2 of the sheets to be printed in the first printing operation+the length L3 of the sheets to be printed in the second printing operation (that is, the case chosen by "YES" at the Step S303).

When the printing film 1 is fed from the feed reel 5 for the second printing operation, a region of the printing film 1 positioned at the edge 14 closer to the feed reel 5 or at a boundary ("boundary line A" in FIG. 2) between the circumference and the recess during the first printing operation is transferred on the circumference of the plate cylinder 2. This boundary line A may be creased by a stepped portion between the circumference and the recess 4, and therefore uneven printing may be caused if an image is formed on the creased boundary line A. Therefore, an image, which is hardly formed on the boundary line A, must be formed on a region closer to the feed reel 5 than the boundary line A is. Accordingly, the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region (Step S304), and an image for the second printing operation is formed on the new region of the printing film 1 fed from the feed reel 5, as illustrated in FIG. 2B.

Figure 2A:
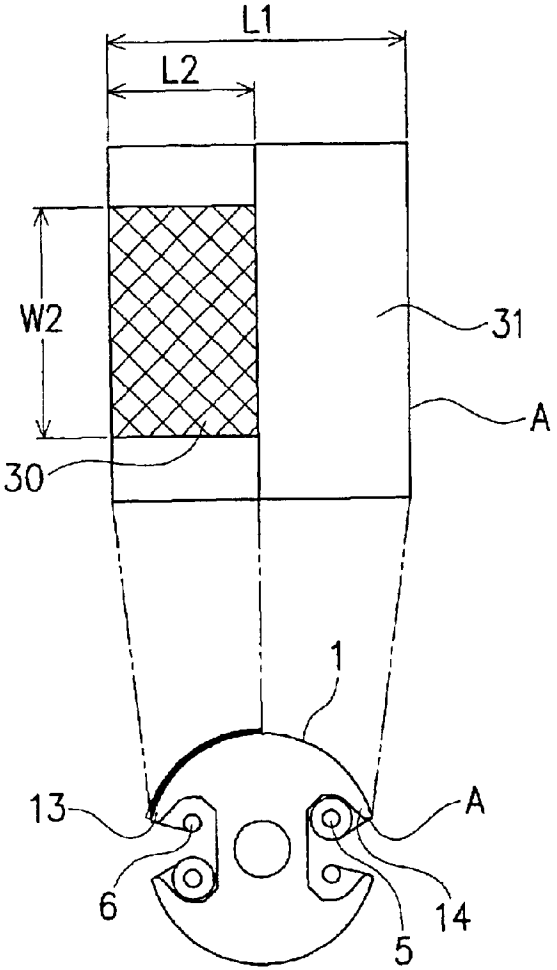
Figure 3A:
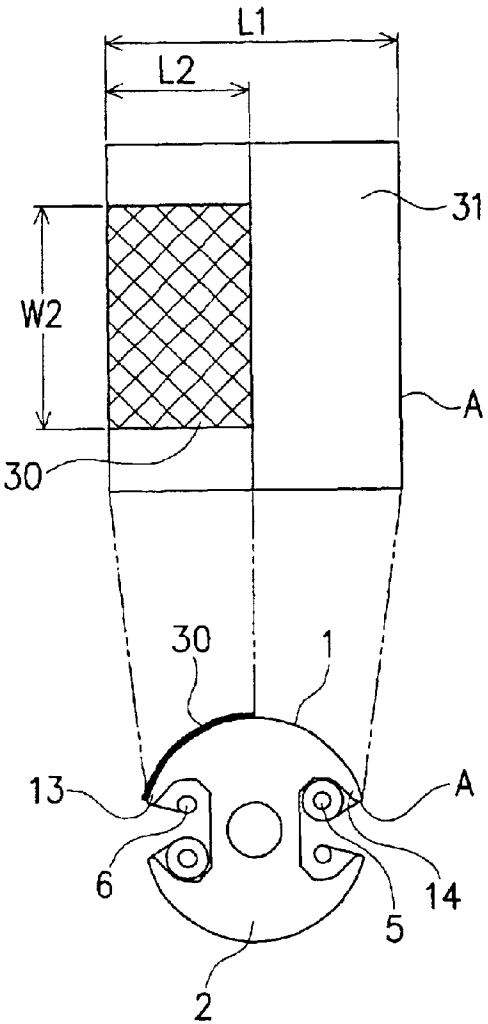
FIGS. 3A, 3B and 3C are schematic views illustrating the procedures for controlling the length of the printing film to be fed from the feed reel of the printing unit according to the one embodiment of the present invention. Specifically.
Figure 3B:
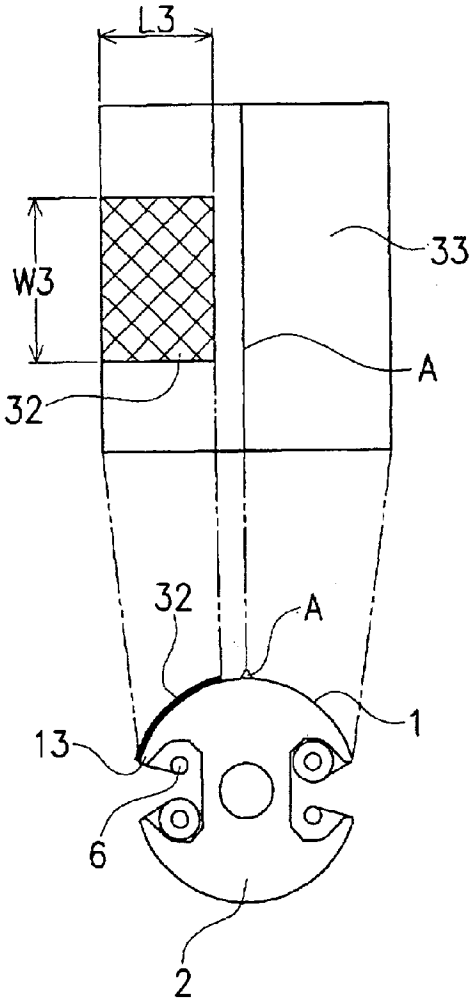
Figure 3C:
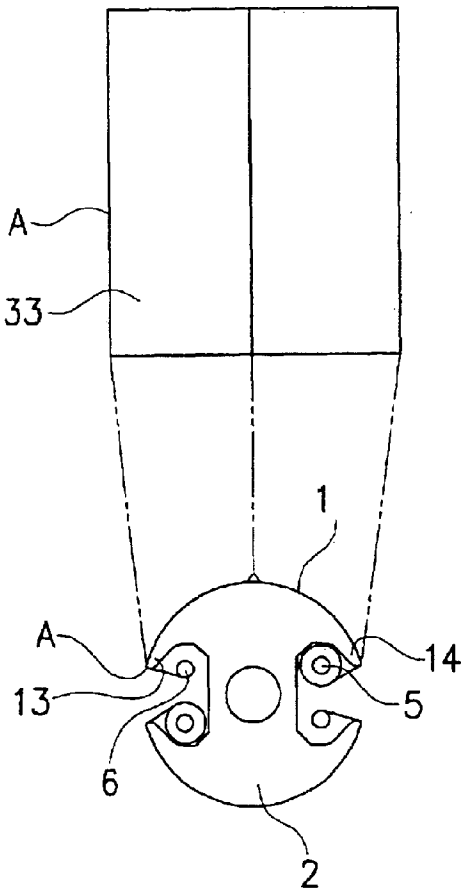
Figure 4:
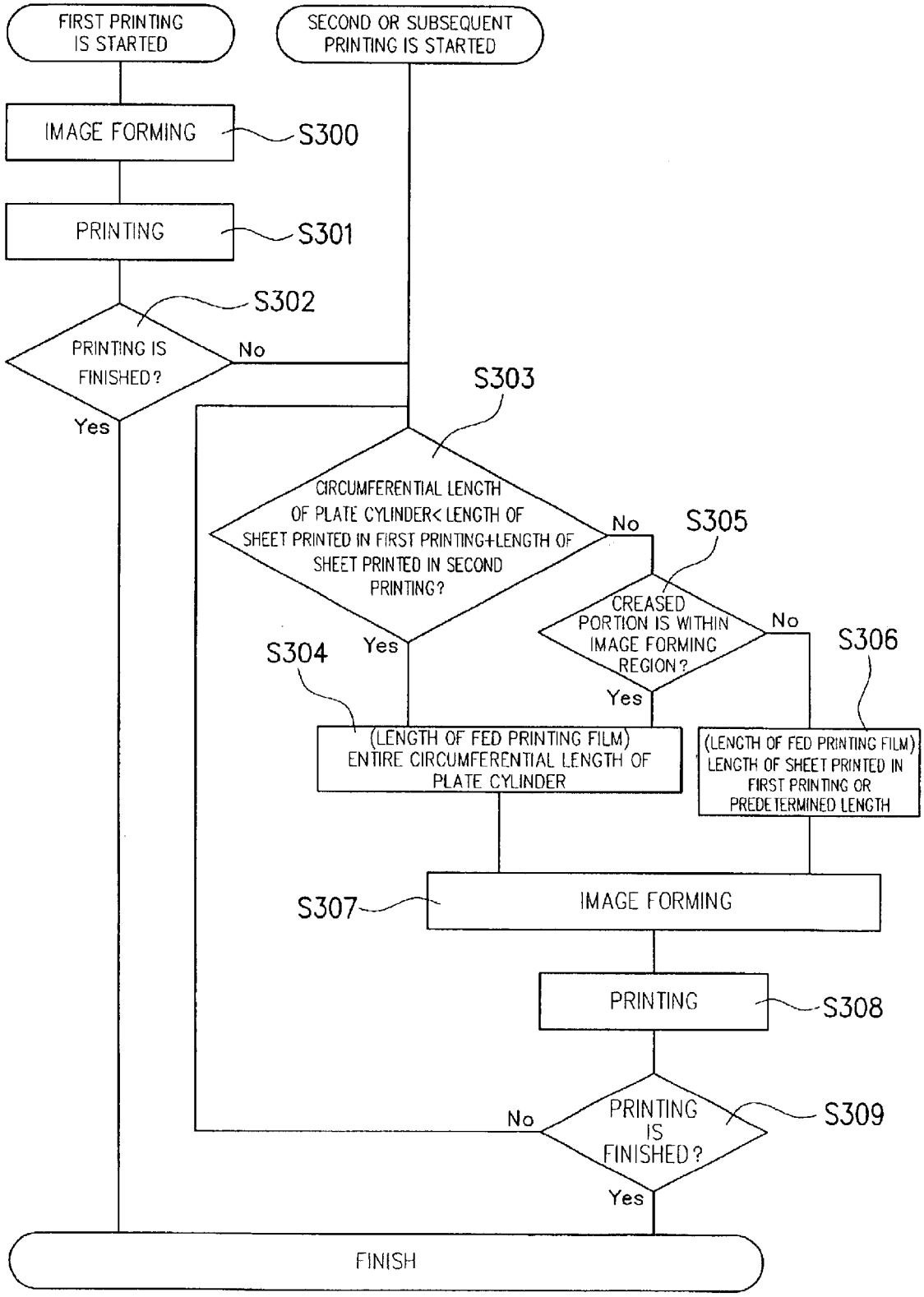
FIG. 4 is a flow chart illustrating the steps for controlling the length of the printing film to be fed from the feed reel by a control device in the printing unit of the one embodiment.

Now, another printing operation will be described by taking for example the second case where when the length L3 of the sheets to be printed in the second printing operation is shorter than the length of the unused region 31 (L1–L2), that is, when the circumferential length L1 between the pair of the feed reel 5 and the rewind reel 6>the length L2 of the sheets to be printed in the first printing operation+the length L3 of the sheets to be printed in the second printing operation (that is, the case chosen by "NO" at the Step S303), with reference to FIG. 3, in which FIG. 3A is the same figure as FIG. 2A, illustrating the printing film with the image forming region 30 on which the image for the first printing operation has been formed (Step S300). In this case, the image forming region 30 for the first printing operation is rewound by the rewind reel 6, causing the printing film 1 to be fed from the feed reel 5 by a length substantially equal to the length L2 of the image forming region 30 (Step S306), and the unused region 31 to be positioned closer to the rewind reel 6 on the circumference of the plate cylinder 2. Then, as illustrated in FIG. 3B, the image for the second printing operation is formed on image forming region 32, which is equal in size to the sheets to be printed in the second printing operation (Step S307). Thus, the second printing operation is performed by using this image. In this printing operation, another unused region 33 is caused on the downstream side of the image forming region 32.

For the third printing operation, which is initiated from the second case (that is, the case chosen by "NO" at the Step S309), when the length of the sheets to be printed in the third printing operation is longer than the length of the unused region 33 (that is, the case chosen by "YES at the Step S303), likewise to the first case, the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region (Step S304), thereby preventing a creased portion from being positioned within an image forming region (Step S304).

For the third printing operation, which is initiated from the second case, when the length of the sheets to be printed in the third printing operation is shorter than the length of the unused region 33 (that is, the case chosen by "NO" at the Step S303), this unused region 33 contains the boundary line A, as illustrated in FIG. 3B, while the printing operation can be performed by using this unused region 33. Therefore, when a portion of the unused region 33, which is closer to the feed reel 5 than the boundary line A is, is longer than the length of the sheets to be printed in the third printing operation (that is, the case chosen by "NO" at the Step S305), the printing film 1 is fed from the feed reel 5 until the boundary line A is transferred to the edge 13 closer to the rewind reel 6 on the circumference of the plate cylinder 2 (Step S306). Whereby, the boundary line A is not positioned within the image forming region for the third printing operation. On the other hand, when the length of the sheets to be printed in the third printing operation is longer than the length of the unused region 33 (that is, the case chosen by "YES" at the Step S305), the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region (Step S304), thereby preventing a creased portion from being positioned within the image forming region (Step S304).

Likewise to the above, when the fourth and subsequent printing operations are continuously performed, the length of the printing film 1 to be fed from the feed reel 5 is controlled by inputting the information on the sheets to be printed according to the flow chart of FIG. 4.

Now, the description will be made for the control of the length of the printing film 1 to be fed, following the flow chart of FIG. 4 with presenting specific numerical values.

The printing unit of this embodiment has a circumferential length L1 of 480 mm (the length of the circumference between the pair of the feed reel 5 and the rewind reel 6), and is designed to be capable of printing sheets having a size between 150 mm (corresponding to the length of a postcard) and 420 mm (corresponding to the length of an A3 sheet.

First, for the case, where the printing operation for sheets having the length equal to the length of a A3-size sheet (simply referred to "A3-size sheets) is initiated after the printing operation for sheets having the length equal to the length of a postcard (simply referred to "postcard-size sheets"), the total length of an A3-size sheet and a postcard-size sheet is longer than the overall length of the circumference of the plate cylinder 2. Therefore, the plate cylinder 2 is fed by a length of 480 mm so as to replace the region of the printing film 1 on the circumference of the plate cylinder 2 entirely by a new region. On the other hand, for example, where another printing operation for the postcard-size sheets is performed subsequent to the printing operation for the postcard-size sheets, the total length of each postcard-size sheet for the previous printing operation and the another one for the current printing operation is shorter than the overall length of the circumference. Accordingly, the printing film 1 is fed by a length of 150 mm. In this case, it is not necessary to have the feeding length equal to the length of the postcard-size sheet, provided that it is set equal to or more than the length of a postcard-size sheet. However, in this embodiment, the upper limit is set at 330 mm.

Now, the description will be made for plural printing operations performed for sheets having a predetermined size. For example, when the printing operation for the postcard-size sheets is performed three times in a continuous manner, and the length of the printing film 1 to be fed from the feed reel 5 is set to 150 mm, the printing film 1 of 30 mm is left unused in the third printing operation. Therefore, in this printing operation, it is preferable to feed the printing film 1 by a length of 160 mm for each printing operation. Likewise, when the printing operation for sheets having the width of an A4 size sheet (210 mm) is performed twice in a continuous manner, it is preferable to feed the printing film 1 by a length of 240 mm for each printing operation.

When the printing operations for sheets having the length of a postcard-size sheet (150 mm) and sheets having the length of an A4 size sheet (300 mm) are subsequently performed, it is preferable to feed the printing film 1 by a length of 160 mm and a length of 320 mm, respectively.

That is, the length of the printing film 1 to be fed is preferably set by the formula (480 mm/integar), where the overall circumferential length of the plate cylinder 2 is 480 mm.

When plural printing operations are performed by the printing unit of this embodiment, the information on the sheets for these printing operations are previously inputted, enabling the control device 20 to control the order of the printing operations, thereby minimizing the length of the printing film 1 to be fed from the feed reel 5.

Figure 5B:
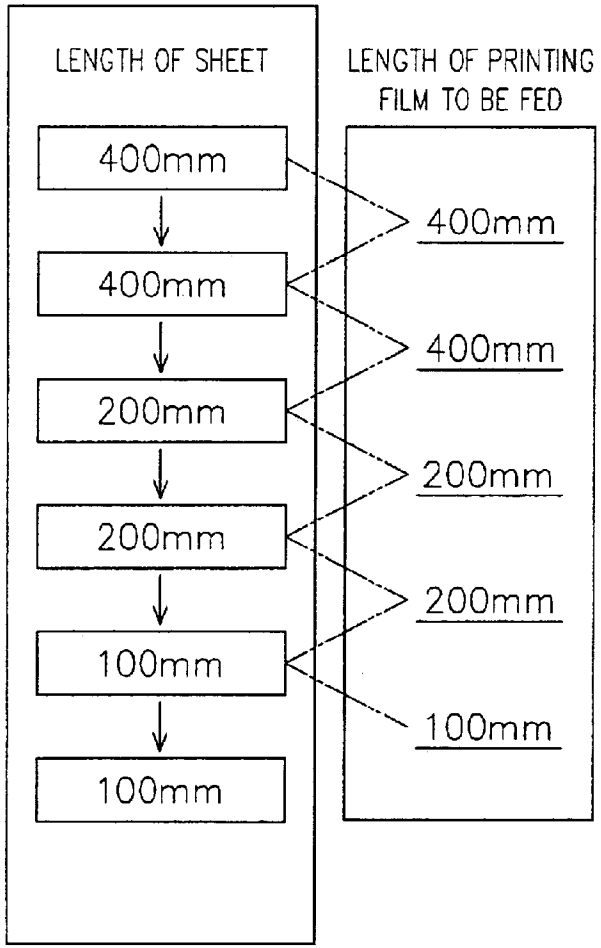
FIGS. 5A and 5B are explanatory views for explaining the sorting of the order of the printing operations when plural printing operations are performed by the printing unit of the one embodiment.
Figure 5A:
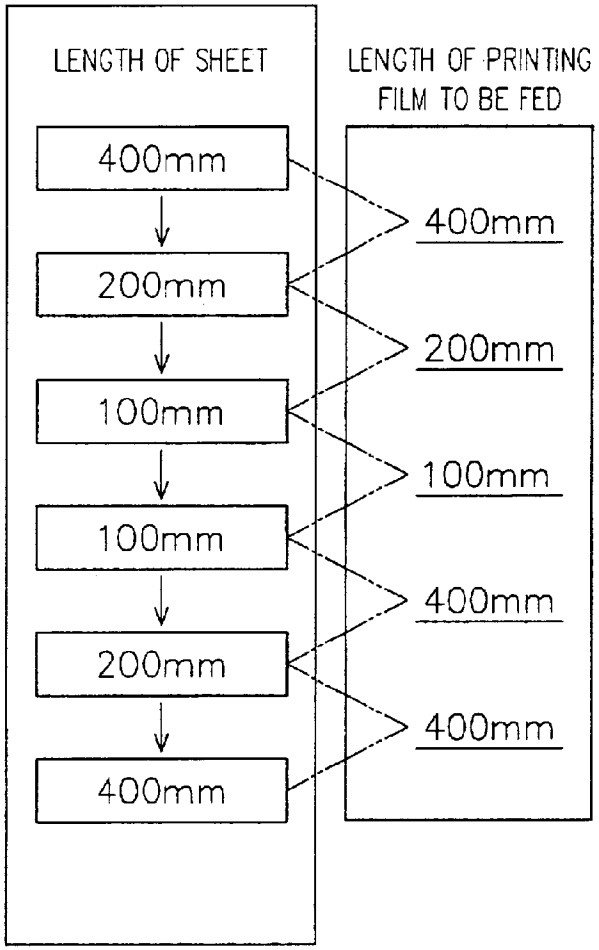

Now, the description will be made for the control of sorting the order of the printing operations by taking a specific example, which is illustrated in FIG. 5. First, the operator inputs arbitrarily the lengths of sheets such as in the order of "400 mm", "200 mm", "100 mm", "100 mm", "200 mm" and "400 mm" into means 21, as illustrated in FIG. 5A. Then, each length is stored in the memory part 22. For example, when the circumferential length L1 of the plate cylinder 2 between the pair of the feed reel 5 and the rewind reel 6 is 400 mm, the order of the sizes are sorted to "400 mm", "400 mm", "200 mm", "200 mm", "100 mm" and "100 mm" by the control device 20, as illustrated in FIG. 5B. That is, the order of the printing operations is sorted following the flow chart of FIG. 4 in such a manner as to enable the feeding length of the printing film 1 to be minimized,. Once the printing operations are performed in the sorted order, the feeding length of the printing film 1 reaches 1300 mm.

Herein, the feeding length of the printing film 1 reaches 1500 mm if the printing operations are performed in the order as illustrated in FIG. 5A. That is, as a result of the sorting operation, the resulting feeding length of the printing film 1 can be reduced by 200 mm.

As described above, in the printing unit of this embodiment, where an image can be formed on an unused region based upon the length of sheets to be printed, the printing film 1 is fed from the feed reel 5 so as to enable the image to be formed on the unused region, thus achieving the reduction of the length of the printing film to be fed from the feed reel 5. As a result, the amount of the printing film 1 to be consumed can be reduced as compared with the conventional printing unit.

When a creased portion of the printing film 1 is positioned within the image forming region 30 or 32, on which an image of the printing film 1 is formed, the printing film 1 is fed from the feed reel 5 by a length substantially equal to the overall circumferential length of the plate cylinder 2, so that the creased portion of the printing film 1 can be prevented from being positioned within the image forming region 30 or 32. Thus, uneven printing can be prevented.

When plural printing operations are performed, the control device 20 sorts the order of the printing operations in such a manner as to minimize the length of the printing film 1 to be fed. Thus, the amount of the printing film 1 to be consumed can be further reduced.

The printing unit of the printing press according to this embodiment is also capable of performing an image-size based feeding control for controlling the length of the printing film 1 to be fed from the feed reel 5 based upon the information representative of the size of an image formed on the printing film 1 on the circumference of the plate cylinder 2. Specifically, the operator inputs the positions of images to be printed on the sheets, as well as the length and width of the sheets to be printed in the first and second printing operations into the input means 21. Then, the position of the image for the first printing operation, which is formed on the printing film 1 on the circumference of the plate cylinder 2, is stored in the memory part 22. Specifically, as the position of the image, the length between the leading edge of the sheets to be printed and the trailing edge of the image to be printed on the sheets (an edge of the image at the trailing edge of the sheet) is inputted into the input means 21 and stored in the memory part 22. Then, when the second printing operation is performed, the printing film 1 with the image for the first printing operation printed thereon is rewound by the rewind reel 6. Also, when the printing film 1 is easy to be creased, the control device 20 controls the length of the printing film 1 to be fed from the feed reel 5 so as to minimize the feeding length and thus prevent a possible creased portion or the boundary line A from being positioned within an image forming region. Thus, the amount of the printing film 1 to be consumed can be reduced in the same manner as above.

According to the printing unit of this embodiment, as described above, the boundary line A of the printing film 1 is positioned on the circumference of the plate cylinder 2 by performing the sheet-size based feeding control and the image-size based feeding control. Silicon debris, ink or any other foreign matters, which have been caused during the printing operation, are likely to be stuck on this boundary line A, and therefore if an image is formed on the printing film 1 by the image forming device 7 without removing those foreign matters stuck on the boundary line A, they are likely to cause an undesirable effect on the image formed on the printing film 1.

In order to address the above problem, after feeding a new region of the printing film 1 on the circumference from the feed reel 5 and before forming an image thereon, the printing film 1 on the circumference of the plate cylinder 2 is cleaned by the wet cleaning device 50 so as to remove the foreign matters stuck on the boundary line A. Thus, an image can be properly formed on the printing film 1.

The printing unit of the printing press according to the present invention further includes a switching means for selectively switching the controlling operation between the circumferential-length-based feeding control, the sheet-size-based feeding control, and the image-size-based feeding control. Specifically, the operator touches an area of the screen, displaying such as "FULL-SIZE", "HEAD & TAIL", and "IMAGE" so as to selectively switch the control mode. Accordingly, when the circumferential-length-based feeding control is performed, the operator touches "FULL-SIZE". Likewise, when the sheet-size-based feeding control or the image-size based feeding control is performed, the operator respectively touches "HEAD & TAIL" or "IMAGE" so as to initiate a desired operation.

The printing unit according to this embodiment enables the operator to selectively switch the control mode by providing the switching means according to various conditions of the printing operation. For example, when the current printing operation is performed subsequent to the previous printing operation in a continuous manner, an image for the current printing operation is printed on a region of the printing film 1, which has not been used in the previous printing operation, when the sheet-size-based feeding control or the image-size-based feeding control has been performed. This means that the unused region of the printing film 1 in the previous printing operation contacts the rubber cylinder in the previous and current printing operations. If a large number of the sheets are printed in the previous and current printing operations, the durability of the unused region of the printing film 1 in the previous printing operation is deteriorated, and an undesirable effect may be caused in the current printing operation. Therefore, if a large number of the sheets are printed in the previous and current printing operations, the operator selects the circumferential-length-based feeding control so as to replace the region of the printing film 1 placed on the circumference of the printing film 1 entirely by a new region. Thus, a proper printing operation is possible. That is, the printing operations can be performed under the most preferably condition by providing the switching means, through which the operator selects the feeding control according to the condition of each printing operation.

As described above, the length of the printing film 1 to be fed is maximized when the circumferential-length-based feeding control has been performed. That is, the number of the printing operations, which can be made by the printing roll 10 set to the feed reel 5, is minimized when the printing film 1 is fed under the circumferential-length-based feeding control. In this regard, it is critical to estimate the replacement timing of the printing roll 10 for the purpose of smooth printing operation by knowing the minimized number of the printing operations, which can be performed by the printing film 1 left in the printing rolls 10. Therefore, the operation panel is provided with a counter, which displays the minimized number of the printing operations, which can be performed by the printing film 1 left in the printing roll 10. In other words, when the printing film 1 has been fed from the printing roll 10 by performing the printing operation, the number of the operations under the circumferential-length-based feeding control or the minimized number of the printing operations, which can be performed by the printing film 1 left in the printing roll 10, are calculated and are displayed by the counter.

Now, the description will be made for the counter's display by presenting specific numerical values. For example, when the effective length (the length to be actually usable, or the length which can be fed on the plate cylinder 2) of the printing film 1 in a single printing roll 10 is 9600 mm, and the length of the printing film 1 to be fed under the circumferential-length-based feeding control is 480 mm, the operations under the circumferential-length-based feeding control can be performed 20 times by this printing roll 10. That is, the minimized number of the printing operations are 20 times, and therefore when the new printing roll 10 is set to the feed reel 5, the counter displays "20".

Then, when the printing film 1 has been fed by 150 mm by the printing operation for the sheets having a length (150 mm) corresponding to the length of a postcard, the effective length of the printing film 1 left in the printing roll 10 is "9600−150=9450 mm", which means that the minimized number of the printing operations is 19 times. Accordingly, the counter displays "19".

Then, when the printing film 1 has been fed by 300 mm by the printing operation for the sheets having a length (300 mm) corresponding to the length of an A4 size sheet under the sheet-size based feeding control, the effective length of the printing film 1 left in the printing roll 10 is "9450−300=9150 mm", which means that the minimized number of the printing operations is 19 times. Accordingly, the number displayed by the counter does not change from "19". Similarly, when the printing film 1 is fed in each of the third and fourth printing operations, the minimized number of the printing operations is calculated based upon the effective length of the printing film 1 left in the printing roll 10. When the effective length of the printing film 1 left in the printing roll 10 becomes shorter than 480 mm, the counter displays "0", so that the operator can find that a further printing operation under the circumferential-length-based feeding control is impossible.

Thus, the counter for displaying the minimized number of the printing operations enables the operator to check the residual amount of the printing film 1 in the printing roll 10, and hence estimate the replacement timing of the printing roll 10. Therefore, it is possible to prevent any troubles causing unexpected discontinuation of the printing operations resulting from the complete consumption of the printing roll 10 after the continuous printing operations.

Meanwhile, in the conventional printing unit, the feeding of the printing film 1 from the feed roll 5 is performed so that a region of the printing film 1 of the circumference of the plate cylinder 2 between the feed reel 5 and the rewind reel 6 is always replaced entirely by a new region (This feeding manner corresponds to the circumferential-length-based feeding control of this embodiment). That is, the length of the printing film 1 to be fed is constant and therefore the number of the printing operations which can be performed by the single printing roll 10 is constant. On the other hand, according to this embodiment of the present invention, the length of the printing film 1 to be fed can be reduced by the printing operations under the sheet-size-based feeding control or the image-size-based feeding control, as compared with the printing operations under the circumferential-length-based feeding control, thereby enabling the number of the printing operations by the single printing roll 10 to be increased. However, the counter only tells the operator about the effective length of the printing film 1 left in the printing roll 10, and therefore the operator cannot know the number of the printing operations which have been performed by the single printing roll 10.

In order to address the above, the printing unit of this embodiment is provided with a display member for displaying the number of the printing operations which have been performed by the single printing roll 10. The display member is provided in the operation panel so as to display the number or the like. Specifically, the display member is designed to display a numerical value corresponding to the number of the printing operations, which is increased every time the printing operation is completed. That is, for example, when the new printing roll 10 has been set to the feed reel 5, the display member displays "0". Then, when the first printing operation has been completed, it accordingly displays "1". Similarly, the display member changes its displayed numerical value to "2", "3", . . . , every time the second, third or subsequent printing operation has been completed. Thus, the operator can easily know the number of the printing operations which have been performed by the single printing roll 10.

Also, when the number of the printing operations by using the single printing roll 10 has been increased by the printing operations under the sheet-size-based feeding control or the image-size-based feeding control, as compared with the conventional printing unit, the number of the completed printing operations can be displayed. For example, when the number of the printing operations which can be performed by the conventional printing operation by using the single printing roll 10 is 20 times, the operator can find that the number of the completed printing operations has been increased from the number of the printing operations which can be made by the conventional printing unit, from the numerical value of the display member displays, which is changed from "20" to "21". By the display member, through which the operator can know that the larger number of the printing operations have been made as compared with the conventional printing unit, the operator can easily confirm that the amount of the consumed printing film 1 has been reduced.

The printing unit of the present invention is not necessarily limited to this embodiment, and therefore may be varied or modified within the intended scope of the present invention. For example, the length of the printing film 1 to be fed from the feed reel 5 may be set at a length slightly longer than the length of the sheets to be printed and the circumferential length L1 of the plate cylinder 2 between the pair of the feed reel 5 and the rewind reel 6.

Even if plural printing operations are performed, it is not necessary to control the printing unit to sort the orders of the printing operations.

In this embodiment, the plate cylinder 2 includes two sections, each including a pair of the feed reel 5 and the rewind reel 6. However, it is a matter of course to provide only the one pair of the feed reel 5 and the rewind reel 6 on the plate cylinder 2.

In this embodiment, when the image-size-based feeding control is performed, the operator inputs the position of the image to be printed on the sheets. The printing unit may be constructed so that the position of the image can be automatically recognized by the control device 20 and the length of the printing film 1 to be fed from the feed reel 5 can be controlled based upon the recognized position. Specifically, the printing unit of the present invention can be constructed so that data representative of the length of the sheets, the information of the image to be printed on the sheets and the like are read out by the control device 20, thereby enabling the control device 20 to calculate the position of the image on the sheet, and hence determine the length of the printing film 1 to be fed from the feed reel 5.

The display member as described above is not limited to the function enabling displaying a numerical value which is added every time the printing operation has been completed up to the time at which the single printing roll 10 has been exhausted. For example, the display member may be constructed so that, when the number of the printing operations has exceeded the minimized the number of the printing operations, such a fact is noticed to the operator by a light signal or word message.

This specification is by no means intended to restrict the present invention to the preferred embodiments set forth therein. Various modifications to the printing unit of a sheet-fed printing press, as described herein, may be made by those skilled in the art without departing from the spirit and scope of the present invention as defined in the appended claims.

What is claimed is:

1. A printing unit of a sheet-fed printing press for printing on sheets comprising:

a plate cylinder having a circumference, on which a recess is formed;

a feed reel mounted within said recess for feeding a printing film onto the circumference of said plate cylinder so as to introduce an image forming region for each printing operation, said image forming region corresponding in size to each of said sheets and having a first edge and a second edge respectively corresponding to a leading edge and a trailing edge of each of said sheets;

an image forming device for forming an image on said image forming region of said printing film fed on the circumference of said plate cylinder with said first edge of said image forming region positioned at an edge of said recess closer to said rewind reel;

a rewind reel mounted within said recess for rewinding said printing film from the circumference of said plate cylinder; and a control unit for controlling the length of said printing film to be fed from said feed reel onto said circumference of said plate cylinder, based upon the length of sheets to be printed for each printing operation.

2. The printing unit of a sheet-fed printing press according to claim 1, wherein said control unit controls the length of said printing film to be fed from said feed reel so that a region of said printing film positioned at a boundary between the circumference of said plate cylinder and said recess in a previous printing operation is prevented from being positioned within a film forming region to be used in a current printing operation when the printing film has been fed from said feed reel.

3. The printing unit of a sheet-fed printing press according to claim 2, wherein said control unit controls the length of said printing film to be fed from said feed reel so that, when the total of the length of sheets to be printed in a current printing operation and the length of sheets which have been printed in a previous printing operation is longer than the circumferential length of said plate cylinder between said feed reel and said rewind reel, the printing film is fed from said feed reel by a length substantially equal to the circumferential length so as to replace a region of said printing film on said circumference of said plate cylinder entirely by a new region, and when the total of the length of sheets to be printed in a current printing operation and the length of sheets which have been printed in a previous printing operation is shorter than the circumferential length of said plate cylinder between said feed reel and said rewind reel, the printing film is fed from said feed reel by a length not less than the length of sheets which have been printed in a previous printing operation, but not more than the length obtained by subtracting the length of sheets to be printed in a current printing operation from the circumferential length.

4. The printing unit of a sheet-fed printing press according to any one of claims 1 to 3, wherein when plural printing operations are continuously performed, the length of sheets to be printed in each printing operation is inputted into said printing unit so that said control unit sorts the order of said plural printing operations based upon said inputted lengths of sheets so as to minimize the length of said printing film to be fed from said feed reel.

5. A printing unit of a sheet-fed printing press for printing on sheets comprising:

a plate cylinder having a circumference, on which a recess is formed;

a feed reel mounted within said recess for feeding a printing film onto the circumference of said plate cylinder so as to introduce an image forming region for each printing operation, said image forming region corresponding in size to each of said sheets and having a first edge and a second edge respectively corresponding to a leading edge and a trailing edge of each of said sheets;

an image forming device for forming an image on said image forming region of said printing film fed on the circumference of said plate cylinder with said first edge of said image forming region positioned at an edge of said recess closer to said rewind reel;

a rewind reel mounted within said recess for rewinding said printing film from the circumference of said plate cylinder; and a control unit for controlling the length of said printing film to be fed from said feed reel onto said circumference of said plate cylinder, based upon the length of an image printed on said printing film on the circumference of said plate cylinder.

6. The printing unit of a sheet-fed printing press according to claim 1, wherein said control device is capable of performing sheet-length-based feeding control for feeding said printing film from said feed reel by the length substantially equal to the circumferential length of the plate cylinder between said feed reel and said rewind reel so as to replace a region of said printing film on said circumference of said plate cylinder between said feed reel and said rewind reel entirely by a new region, image-size-based feeding control for controlling the length of said printing film to be fed from said feed reel onto said circumference of said plate cylinder based upon the size of an image to be formed on said printing film on the circumference of said plate cylinder, and sheet-size-based feeding control for controlling the length of said printing film to be fed from said feed reel onto said circumference of said plate cylinder based upon the length of sheets to be printed, wherein said printing unit further comprises a switching means for selectively switching the film feeding control between said sheet-length-based feeding control, said image-size-based feeding control and said sheet-size-based feeding control.

7. The printing unit of a sheet-fed printing press according to any one of claims 1–3 or 5–6, further comprising a cleaning device for cleaning said printing film, which has been fed on said circumference of said plate cylinder, before an image is formed on said printing film.

8. The printing unit of a sheet-fed printing press according to any one of claims 1–3 or 5–6, further comprising a display means for displaying the fact that the number of printing operations which have been performed has exceeded the number of printing operations which can be performed by a single roll of said printing film set to said feed reel when the printing film is fed from said feed reel for each printing operation by the length substantially equal to the circumferential length of said plate cylinder between the feed reel and said rewind reel so as to replace a region on said circumference of said plate cylinder between said feed reel and said rewind reel entirely by a new region.

9. The printing unit of a sheet-fed printing press according claim 4, further comprising a cleaning device for cleaning said printing film, which has been fed on said circumference of said plate cylinder, before an image is formed on said printing film.

10. The printing unit of a sheet-fed printing press according claim 4 further comprising a display means for displaying the fact that the number of printing operations which have been performed has exceeded the number of printing operations which can be performed by a single roll of said printing film set to said feed reel when the printing film is fed from said feed reel for each printing operation by the length substantially equal to the circumferential length of said plate cylinder between the feed reel and said rewind reel so as to replace a region on said circumference of said plate cylinder between said feed reel and said rewind reel entirely by a new region.

11. The printing unit of a sheet-fed printing press according to claim 7, further comprising a display means for displaying the fact that the number of printing operations which have been performed has exceeded the number of printing operations which can be performed by a single roll of said printing film set to said feed reel when the printing film is fed from said feed reel for each printing operation by the length substantially equal to the circumferential length of said plate cylinder between the feed reel and said rewind reel so as to replace a region on said circumference of said plate cylinder between said feed reel and said rewind reel entirely by a new region.

* * * * *